United States Patent [19]

Maurer et al.

[11] 4,134,372

[45] Jan. 16, 1979

[54] VALVE ROTATING DEVICE

[75] Inventors: Ruprecht Maurer; Karlheinz Timtner, both of Bad Homburg von der Hohe, Fed. Rep. of Germany

[73] Assignee: Ringspann Albrecht Maurer K.G., Bad Homburg von der Hohe, Fed. Rep. of Germany

[21] Appl. No.: 841,373

[22] Filed: Oct. 12, 1977

[30] Foreign Application Priority Data

Oct. 15, 1976 [DE] Fed. Rep. of Germany ..... 2646535

[51] Int. Cl.[2] ..... F01L 1/32

[52] U.S. Cl. ..... 123/90.28; 137/331; 137/243

[58] Field of Search ..... 123/90.28, 90.29, 90.3; 137/330, 331 X, 243 X, 243.1; 251/229

[56] References Cited

U.S. PATENT DOCUMENTS

| | | | |
|---|---|---|---|
| 1,005,897 | 10/1911 | Shields et al. | 137/331 |
| 1,018,591 | 2/1912 | Sperry | 123/90.28 |
| 1,044,408 | 11/1912 | Meyer | 137/331 |
| 1,052,939 | 2/1913 | Meyer | 137/331 |
| 1,314,378 | 8/1919 | Tismer | 123/90.28 |
| 1,314,949 | 9/1919 | Crowther | 123/90.28 |
| 1,467,674 | 9/1923 | Kidd | 123/90.28 |
| 1,569,887 | 1/1926 | Sargent | 123/90.28 |

FOREIGN PATENT DOCUMENTS

| | | | |
|---|---|---|---|
| 1301333 | 8/1969 | Fed. Rep. of Germany | 123/90.28 |
| 2054349 | 5/1972 | Fed. Rep. of Germany | 123/90.28 |
| 2054350 | 10/1972 | Fed. Rep. of Germany. | |
| 2054351 | 5/1972 | Fed. Rep. of Germany. | |

*Primary Examiner*—Ronald H. Lazarus
*Assistant Examiner*—Jeffrey L. Yates
*Attorney, Agent, or Firm*—Spencer & Kaye

[57] ABSTRACT

A device for rotating a reciprocating valve executing alternating opening and closing strokes has an overrunning clutch coupled to the valve stem; a control lever; a first articulation connecting the control lever to the overrunning clutch; and a second articulation supporting the control lever at a distance from the overrunning clutch. The control lever is arranged to impart to the overrunning clutch a torque derived from the reciprocating motion of the valve. The overrunning clutch transmits the torque to the stem for effecting rotation thereof about the stem axis solely during the closing strokes. The second articulation is situated at a predetermined fixed location selected such that a line connecting the articulations defines a first angle with the valve stem axis at the end of each closing stroke and a second angle at the end of each opening stroke. The first angle is acute and the second angle is at the most 90° and is greater than the first angle.

7 Claims, 3 Drawing Figures

VALVE ROTATING DEVICE

BACKGROUND OF THE INVENTION

This invention relates to a device for rotating valves, particularly the valves of internal combustion engines. The device has a control lever which is supported on the stationary engine housing and which is operatively connected with an overrunning clutch which, in turn, is coupled to the valve stem. The rotary motion imparted by the control lever to the overrunning clutch is transmitted by the latter to the valve stem only during the closing strokes of the valve.

A device of the above-outlined type is disclosed, for example, in German Pat. No. 1,301,333. In the device described in that patent, the drive of the overrunning clutch coupled with the valve stem is effected by a guide member which moves in a stationary slide track arranged at an oblique inclination to the direction of the valve stroke. The valve, as it executes its strokes, is rotated about the stem axis through an angle which is a function of the above-noted oblique inclination. By means of the overrunning clutch, the rotary motion is transmitted to the valve stem solely during the closing strokes of the valve in order to ensure a grinding action between the valve head and the valve seat as the valve closes.

It is a disadvantage of the above-outlined known valve rotating device that, particularly because of the slide-type guidance, it is expensive to manufacture. Further, its installation in the cylinder head causes construction problems, particularly in case of large engines, such as ship engines which have usually four valves for every cylinder. Further, a subsequent installation of the known rotating device on already existing engines (for example because of a conversion to another fuel such as heavy oil) is practically impossible.

Further, in case of a slide track of linear course, the angle of rotation of the valve is proportional to the stroke; thus, the rotational velocity is constant. In order to ensure, that, advantageously, the valve has a high rotary velocity shortly prior to its engagement with the valve seat, the slide track would have to be of arcuate course. This, however, would further increase the costs of manufacture, installation and particularly, adjustment. German Laid-Open Application (Offenlegungsschrift) No. 2,054,349 discloses a linkage drive which effects an accelerated rotation of the valve. The valve rotating device disclosed in the last-named reference, however, involves a relatively complex assembly and complex parts.

Further, in German Laid-Open Application (Offenlegungsschrift) No. 2,054,350 there is disclosed a valve rotating device, according to which the guide member sliding in a stationary slide track is directly connected with the sprags of the overrunning clutch. This valve rotating device, however, involves, because of its slide-type guide, the same problems inherent in the above-discussed German Pat. No. 1,301,333.

SUMMARY OF THE INVENTION

It is an object of the invention to provide an improved valve rotating device of the above-outlined type, from which the discussed disadvantages are eliminated and which is of simple and inexpensive structure and which is also adapted for subsequent installation.

It is a further object of the invention to provide an improved valve rotating device of the above-outlined type with which high rotational velocities with smooth transition may be achieved.

These objects and others to become apparent as the specification progresses, are accomplished by the invention, according to which, briefly stated, the device for rotating a reciprocating valve executing alternating opening and closing strokes has an overrunning clutch coupled to the valve stem; a control lever; a first articulation connecting the control lever to the overrunning clutch; and a second articulation supporting the control lever at a distance from the overrunning clutch. The control lever is arranged to impart to the overrunning clutch a torque derived from the reciprocating motion of the valve. The overrunning clutch transmits the torque to the stem for effecting rotation thereof about the stem axis solely during the closing strokes. The second articulation is situated at a predetermined fixed location selected such that a line connecting the articulations defines a first angle with the valve stem axis at the end of each closing stroke and a second angle at the end of each opening stroke. The first angle is acute and the second angle is at the most 90° and is greater than the first angle.

By virtue of the above-defined arrangement of the control lever, a rotary motion is derived from the reciprocating motion of the valve in a particularly simple manner. The expenses concerning components and installation are significantly reduced and above all, the stationary point of articulation (second articulation) for the control lever may be arranged without any problem on the engine, for example, directly at one of the cylinder head bolts. Thus, a subsequent installation of the device on an engine already in service is feasible without difficulties. It is a particular advantage of the invention that the rotary motion of the valve stem effected by the control lever is not of constant speed but is accelerated in such a manner that immediately before the valve head engages the valve seat, the highest rotary velocity is achieved. Accordingly, the maximum rotational energy is available for effecting a grinding of the seat faces by the valve head. The arrangement according to the invention ensures that the rotary motion is imparted to the valve stem gradually, so that the overrunning clutch is not stressed by dangerously high starting thrusts, and further, the wear is reduced to a significant degree.

Regarding the arrangement of the overrunning clutch, several different possibilities can be considered. For example, it may be arranged in a known manner coaxially at the end of the valve stem and may be directly and torque-transmittingly attached thereto. In case a valve bell is used, the overrunning clutch may be arranged to exert its torque thereon, or it may be arranged between the valve bell and the valve stem.

The articulations of the control lever are expediently ball joints, because that terminus of the control lever which duplicates the reciprocating motion of the valve, executes a helical motion. The control lever itself is advantageously formed of two coaxial, threadedly engaged lever parts each terminating in a securing lug. These components are readily available items and can be adjusted to the appropriate length. Subsequently, the two threaded lever parts may be immobilized by a counter nut.

DESCRIPTION OF THE PREFERRED EMBODIMENT

Figure 1:
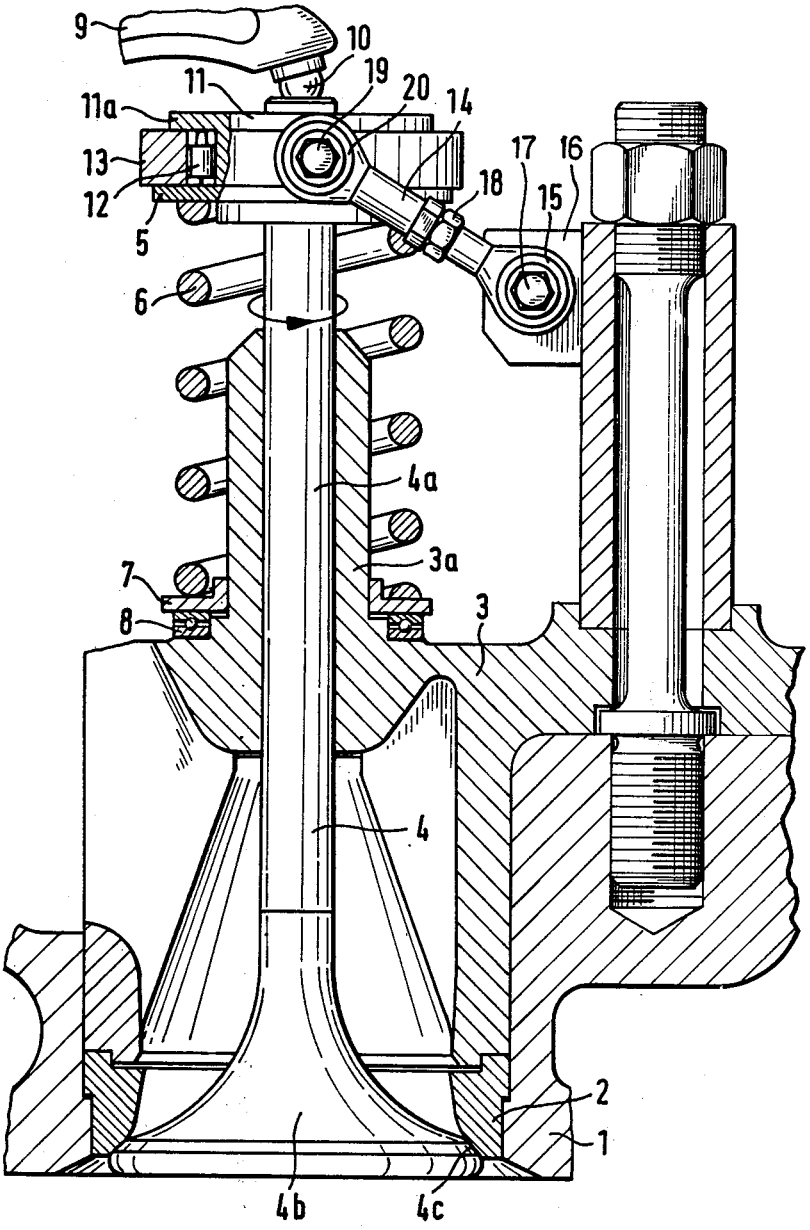
FIG. 1 is a longitudinal sectional view of a valve assembly incorporating a preferred embodiment of the invention.
Figure 2:
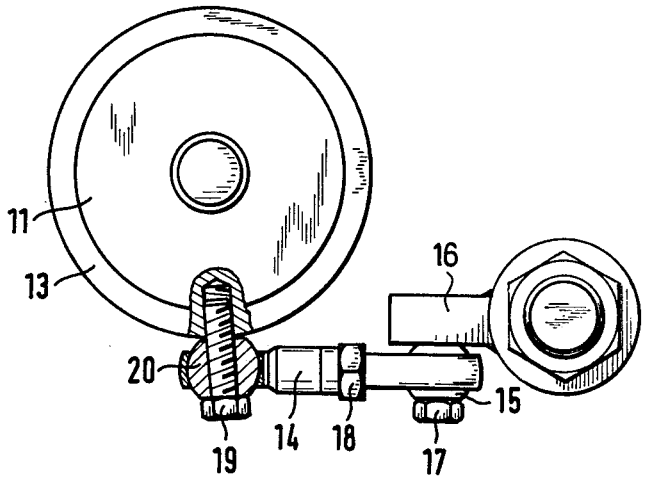
FIG. 2 is a top plan view, partially in section, of one part of the structure shown in FIG. 1.

Turning now to FIG. 1, in a cylinder head 1 of an internal combustion engine there is secured a valve seat ring 2 and a valve housing 3. In the valve guide portion 3*a* of the valve housing 3 there is slidably supported the stem 4*a* of a valve 4. The latter has a valve head 4*b* which, in its position illustrated in FIG. 1, is in its closed position in which it engages, with its seating face 4*c*, the valve seat ring 2 in an airtight manner.

A valve spring 6 coaxially surrounds the valve guide 3*a* and engages, with its upper end, the upper free terminus of the valve stem 4*a* with the intermediary of a spring seat disc 5. The lower end of the spring 6 is supported on the valve housing 3 with the intermediary of a spring seat disc 7 and a ball bearing 8. This arrangement ensures that the valve is urged (pulled) in a conventional manner towards its closed position. The opening motion is effected by a rocker arm 9 which engages the upper terminus of the valve stem 4*a* with the intermediary of a ball joint 10.

The upper free terminus of the valve stem 4*a* is fixedly connected with the inner ring 11 of an overrunning clutch arranged coaxially with the valve stem. At its upper side, the inner ring 11 has a radially outwardly projecting collar 11*a* which extends over the sprags 12 and the upper side of an outer ring 13 of the overrunning clutch. The outer ring 13 is constrained to follow the reciprocating motion of the valve 4 and the inner ring 11 by virtue of the collar 11*a* and the spring seat disc 5 (which is attached to the inner ring 11.) The height (that is, the axial dimension) of the outer ring 13 is of such a magnitude that it may execute, in a play-free manner, angular displacements relative to the inner ring 11 and relative to the spring seat disc 5 during the operational phases when the overrunning clutch does not block such a rotation. The locking direction of the overrunning clutch is illustrated by the circular arrow drawn around the valve stem 4*a*. In case the outer ring 13 is rotated in the direction of the circular arrow (by means of an arrangement to be described later), the sprags 12 cause the inner ring 11 to move with the outer ring 13 as a unit, whereupon the valve 4, the spring seat discs 5 and 7 as well as the valve spring 6 execute a rotary motion about the longitudinal axis of the valve stem 4*a*.

A control lever 14 is, at one end, swivelably mounted on the outer ring 13 of the overrunning clutch by means of a ball joint 20 and a securing screw 19. The other end of the control lever 14 is mounted, by means of a further ball joint 15, to the engine housing, preferably by means of a strap 16 held by a cylinder head bolt. The ball joint 15 is mounted on the strap 16 by means of a bolt 17 passing through the joint.

As illustrated in FIG. 1, the control lever 14 is formed of two threadedly engaged, axially aligned cylindrical lever parts, whose total length may be adjusted by means of the threaded connection after loosening a counter nut 18.

The location of attachment of the ball joint 15 of the control lever 14 is situated in the vicinity of a plane which is tangential to the outer face of the outer ring 13 and which passes through the articulation 19 between the outer ring 13 and the control lever 14. The location of attachment of the articulations 15 and 20 are so arranged with respect to one another that in the closed position of the valve 4, the control lever 14, viewed from the articulation 15, points away from the valve head 4*b* at an angle $\alpha$ of preferably between 20°–60° with respect to a plane oriented perpendicularly to the valve stem axis. Stated in different terms, a line connecting the articulations 15 and 20 with one another defines an acute angle (oriented towards the valve head) with the valve stem axis.

In the description that follows, the operation of the above-described valve rotating device will be set forth.

During the opening stroke of the valve, the control lever 14 is, when viewed, for example, at the articulation 15, swung downwardly to an extent determined by the valve stroke. Since the articulation 20 is constrained to move along an arc with respect to the center of the articulation 15 and since, further, the outer ring 13 is driven by the valve 4 linearly along a chord of that arc, the control lever 14 applies a torque to the outer ring 13. The latter, being rotarily mounted, thus executes an angular displacement in addition to its linear shift. During the opening stroke of the valve 4, the outer ring 13 rotates in a direction opposite to the circular arrow drawn around the valve stem 4*a*. This rotary motion thus is not transmitted to the valve 4. When the maximum open positions obtained, the control lever 14 extends approximately perpendicularly to the valve stem 4*a*. Thus, the above-noted acute angle which the line connecting the articulations 15 and 20 defines with the valve stem axis at the end of each closing stroke is increasing during the opening stroke and, at the end of each opening stroke assumes a value of approximately 90°.

During the subsequent closing stroke of the valve 4, the control lever 14 is swung upwardly. During this displacement, the outer ring 13 of the overrunning clutch is rotated by the control lever in the direction of the circular arrow (that is, in the locking direction of the sprags). Consequently, this rotary motion is transmitted to the valve 4 and thus also to the valve spring 6 and the spring seat discs 5 and 7. The speed of the rotary motion continuously increases as the closing stroke progresses, since the control lever, as its inclination with respect to the valve stem axis decreases, causes a continuously increasing rotary displacement of the outer ring 13 for identical stroke increments.

Figure 3:
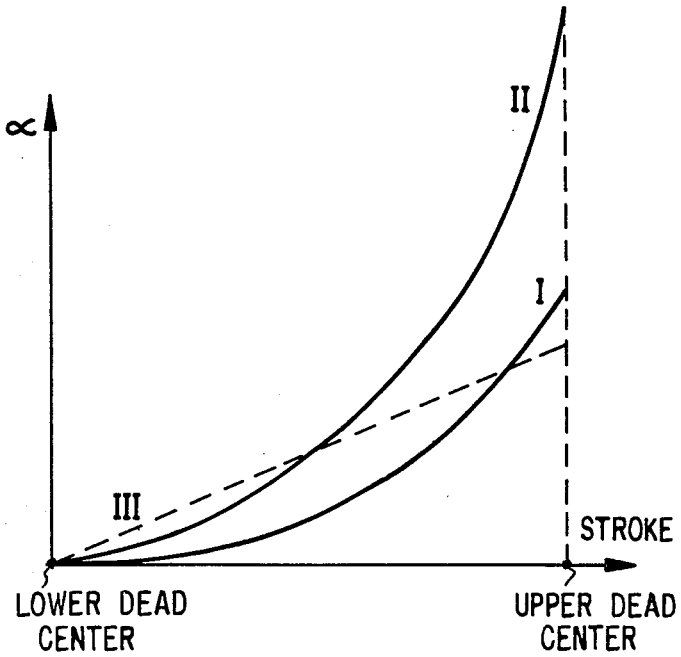
FIG. 3 is a diagram illustrating the course of the rotational angle of the valve as a function of the valve stroke.

The course of the angular displacement $\alpha$, as a function of the valve stroke during the closing stroke of the valve is illustrated in the FIG. 3 for two different positions of the stationary articulation (ball joint) 15.

Considering first the curve I, the latter characterizes a position for the articulation 15 which is at the same height level as the articulation 20 in the fully open position of the valve. Stated differently, in the fully open position of the valve 4, the control lever 14 (or a line connecting the articulations) is oriented perpendicularly to the axis of the stem 4*a*. A higher positioning (assuming a vertical valve stroke) of the articulation 15 would not make sense mechanically, since in such a case it would cause a backwards rotation of the outer ring 13; consequently, parts of the valve stroke would remain needlessly unutilized.

The above-given positioning of the articulation 15 results, during the closing stroke of the valve, in a wholly jar-free rotary acceleration, because the initial angular displacement per mm stroke is zero. Accordingly, the curve I tangentially touches the abscissa at the zero point.

The curve II is based on a somewhat lower positioning of the articulation 15. Thus, in the fully open position of the valve, the control lever 14, as viewed from the articulation 15, is slightly inclined away from the valve head 4*b*. This means that the initial rotary angle per mm stroke is greater than zero and accordingly, its rotational energy too, at the end of the closing motion, is greater than in the first-discussed case (curve I).

The curvature of the curves I and II may be varied by adjusting the length of the control lever 14 and by changing the distance of the articulation 20 from the valve stem axis.

The dashed curve III is shown in FIG. 3 for purposes of comparison; it characterizes the course of the rotary motion of the valve as a function of the valve stroke in a slide-type valve rotating device as disclosed in German Pat. No. 1,301,333 or German Laid-Open Application No. 2,054,350. The curve III thus shows that in case of a linear slide track there exists a direct proportionality between stroke and angle of rotation. With this arrangement there will be a high initial acceleration without achieving a particularly high speed at the end of the closing stroke.

In summary, the advantage of the invention resides in that the valve rotating device is very economical concerning the structure and installation and further, it ensures very high terminal velocities despite a smooth start of the rotary motion.

It will be understood that the above description of the present invention is susceptible to various modifications, changes and adaptations, and the same are intended to be comprehended within the meaning and range of equivalents of the appended claims.

What is claimed is:

1. In a device for rotating a reciprocating valve having a stem and executing alternating opening and closing strokes; the device having an overrunning clutch coupled to the valve stem; a control lever; first attachment means connecting the control lever to the overrunning clutch; second attachment means supporting the control lever at a distance from the overrunning clutch; the control lever being arranged to impart to the overrunning clutch a torque derived from the reciprocating motion of the valve; the overrunning clutch being arranged to transmit the torque to the stem for effecting rotation thereof about the stem axis solely during the closing strokes; the improvement wherein said first attachment means is a first articulation joining said control lever to said overrunning clutch and said second attachment means is a second articulation joining said control lever to a stationary component; said second articulation being situated at a predetermined fixed location selected such that a line connecting said articulations defines a first angle with the valve stem axis at the end of each closing stroke and a second angle at the end of each opening stroke; said first angle being an acute angle and said second angle being 90° at the most and being greater than said first angle.

2. A device as defined in claim 1, wherein said overrunning clutch is arranged coaxially with the valve stem axis.

3. A device as defined in claim 1, wherein the valve is a component of an internal combustion engine and serves a cylinder thereof; further comprising means affixing said second articulation to a cylinder head bolt of the cylinder.

4. A device as defined in claim 1, wherein said overrunning clutch has an inner ring affixed to said valve stem and an outer ring surrounding said inner ring; said first articulation connecting said control lever with said outer ring.

5. A device as defined in claim 1, wherein said articulations are constituted by ball joints.

6. A device as defined in claim 1, wherein said control lever comprises two longitudinally aligned, threadedly interconnected, length-adjustable lever parts.

7. A device as defined in claim 1, further comprising a valve housing including means for guiding said valve stem; a valve spring having a first end supported by said housing and a second end engaging said valve stem for urging said valve into its closed position; and a ball bearing interposed between said housing and said first end of said valve spring.

* * * * *